US010170254B1

(12) United States Patent
Tsai

(10) Patent No.: US 10,170,254 B1
(45) Date of Patent: Jan. 1, 2019

(54) KEY STRUCTURE

(71) Applicant: Primax Electronics Ltd., Taipei (TW)

(72) Inventor: Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/813,385

(22) Filed: Nov. 15, 2017

(30) Foreign Application Priority Data

Sep. 15, 2017 (TW) ..... 106131799 A

(51) Int. Cl.
*H01H 13/705* (2006.01)
*H01H 13/14* (2006.01)
*H01H 13/704* (2006.01)
*H01H 3/12* (2006.01)

(52) U.S. Cl.
CPC ..... *H01H 13/705* (2013.01); *H01H 3/12* (2013.01); *H01H 13/14* (2013.01); *H01H 13/704* (2013.01)

(58) Field of Classification Search
CPC ..... H01H 13/705; H01H 3/12; H01H 13/14; H01H 13/704
USPC ..... 200/341, 344, 345, 511–513, 529, 520, 200/528, 533
See application file for complete search history.

(56) References Cited

U.S. PATENT DOCUMENTS 5,626,223 A * 5/1997 Lee ..... H01H 13/20 200/341
5,746,309 A * 5/1998 Neyer ..... H01H 13/58 200/302.2

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

The present invention relates to a key structure, including a flexible key cap, a conducting plate, a switch circuit board capable of generating a key signal, and an elastic element. The conducting plate is fixed on an inner surface of the flexible key cap and in contact with a plurality of inner sidewalls of the flexible key cap. The switch circuit board is disposed below the conducting plate, and the elastic element is disposed between the conducting plate and the switch circuit board. When the flexible key cap receives the pressing force, the conducting plate twists due to deformation of the flexible key cap, and pushes the plurality of inner sidewalls of the flexible key cap, so as to conduct a pressing force to a corner of the flexible key cap.

10 Claims, 4 Drawing Sheets

KEY STRUCTURE

FIELD OF THE INVENTION

The present invention relates to a key structure, and in particular, to a key structure having a thin and light appearance.

BACKGROUND OF THE INVENTION

Common peripheral input devices of a computer include a mouse, a keyboard device, a trackball device, and the like. The keyboard can be used by users to directly input words and symbols to the computer and is therefore draw attention from users and input device manufacturers. A keyboard including a scissor-type connecting element is pretty common.

Subsequently, the architecture of a key structure in a keyboard having a scissor-type connecting element is described. Referring to FIG. 1, FIG. 1 is a schematic cross-sectional side view of a conventional key structure. A conventional key structure 1 includes a key cap 11, a scissor-type connecting element 12, an elastic rubber body 13, a membrane switch circuit 14, and a baseboard 15, and the baseboard 15 is configured to bear the key cap 11, the scissor-type connecting element 12, the elastic rubber body 13, and the membrane switch circuit 14. The scissor-type connecting element 12 is configured to connect the baseboard 15 and the key cap 11.

The scissor-type connecting element 12 is located between the baseboard 15 and the key cap 11 and separately connects the baseboard 15 and the key cap 11. The scissor-type connecting element 12 includes a first frame 121 and a second frame 122. A first end of the first frame 121 is connected to the key cap 11, and a second end of the first frame 121 is connected to the baseboard 15. The elastic rubber body 13 is surrounded by the scissor-type connecting element 12, and the membrane switch circuit 14 has a plurality of key connecting points (not shown). The key connecting points output corresponding key signals when being triggered. The elastic rubber bodies 13 are disposed on the membrane switch circuit 14 and one elastic rubber body 13 corresponds to one key connecting point. When an elastic rubber body 13 is triggered, the elastic rubber body 13 deforms and presses a corresponding key connecting point in the membrane switch circuit 14, to generate a key signal.

Subsequently, the operation of a conventional key structure 1 when being pressed by a user is described. In FIG. 1, when a user presses the key cap 11, the key cap 11 is under a stress and pushes the scissor-type connecting element 12 to move. Therefore, the key cap 11 may move downwards relative to the baseboard 15 and presses a corresponding elastic rubber body 13. At this time, the elastic rubber body 13 deforms and presses the membrane switch circuit 14, to trigger a key connecting point of the membrane switch circuit 14, so that the membrane switch circuit 14 outputs a corresponding key signal. When the user stops pressing the key cap 11, the key cap 11 is no longer under a stress and stops pressing the elastic rubber body 13, so that the elastic rubber body 13 recovers to the original state due to its elasticity and meanwhile provides an upward elastic restoring force, and the key cap 11 is therefore pushed back to the position before being pressed. The foregoing is the structure and operation of a conventional key structure.

With advances of science and technology, users have an increasingly requirement for light and thin of keyboards, and manufacturers of keyboards are focused in research and development of a thinner and lighter key structure. However, the key structures developed by the manufacturers are still limited by the structure of the connecting element such as the scissor-type connecting element that connects the key cap and the baseboard, and the reduction in thickness is limited. Therefore, a key structure using a flexible key cap is provided on the market. The flexible key cap is made of an elastic rubber material. No scissor-type connecting element is disposed in such the key structure and the thickness of the key structure can therefore be reduced.

However, a new problem appears without configuring a scissor-type connecting element: uneven stress is apt to occur to the flexible key cap. For example, when a user presses a corner of the flexible key cap, a pressing force applied to the flexible key cap by the user cannot be conducted from the corner to the whole flexible key cap because the flexible key cap is made of a flexible elastic rubber material and the support force of the flexible key cap is not sufficient without configuring a scissor-type connecting element. That is, uneven stress of the flexible key cap is apt to occur when the user presses, and therefore it is impossible to generate a key signal, resulting in maloperation.

Therefore, a key structure having a thin and light appearance and capable of avoiding maloperation is needed.

SUMMARY OF THE INVENTION

An objective of the present invention lies in providing a key structure having a thin and light appearance and capable of avoiding maloperation.

In a preferably embodiment, the present invention provides a key structure, including a flexible key cap, a conducting plate, a switch circuit board, and an elastic element. The flexible key cap is exposed out of the key structure and configured to be pressed to deform. The conducting plate is fixed on an inner surface of the flexible key cap and in contact with a plurality of inner sidewalls of the flexible key cap. The switch circuit board is disposed below the conducting plate and configured to be triggered due to deformation of the flexible key cap, so as to generate a key signal. The elastic element is disposed between the conducting plate and the switch circuit board and configured to be pushed by the conducting plate to press the switch circuit board, where when the flexible key cap is pressed and receives a pressing force, the conducting plate twists due to the flexible key cap that deforms and pushes the plurality of inner sidewalls of the flexible key cap, so as to conduct the pressing force to a corner of the flexible key cap.

In a preferable embodiment, the flexible key cap includes a plurality of oblique pyramids and a fixing column. Each of the oblique pyramids corresponds to the inner sidewall of the key cap and extends out of the corresponding inner sidewall of the key cap, and the oblique pyramid is disposed on the corresponding inner sidewall of the key cap and is approximate to the corner of the flexible key cap. The fixing column is disposed on an inner surface of the key cap and extends out of the inner surface of the key cap. 3 The oblique pyramid has an asymmetrical slope, facing the inner surface of the key cap and configured to contact the conducting plate, and the twisted conducting plate is pushed, to conduct the pressing force to the corner of the flexible key cap.

In a preferable embodiment, the conducting plate includes a body and a plurality of extended protrusions, the body has an opening, and the fixing column is enabled to pass through the opening, to fix the body onto the inner surface of the flexible key cap. The plurality of extended protrusions extends out of the body, each of the extended protrusions corresponds to one of the oblique pyramids, and each of the extended protrusions has a contact slope, corresponding to the asymmetrical slope and configured to contact the corresponding asymmetrical slope.

In brief, in the key structure of the present invention, the problem of uneven stress of the flexible key cap is alleviated by utilizing the structure of the flexible key cap and the conducting plate. Each inner sidewall of the flexible key cap is provided with an oblique pyramid, and the oblique pyramid is approximate to a corner of the flexible key cap. In addition, the conducting plate has extended protrusions that extend out of the body, so as to respectively contact the oblique pyramids. The oblique pyramid has an asymmetrical slope facing upwards, and the extended protrusion has a contact slope facing downwards. When the flexible key cap receives a pressing force to deform, the pressing force may be conducted to a corner of the flexible key cap by means of the body, the extended protrusion, and the oblique pyramid. In this way, the problem of uneven stress of the flexible key cap can be resolved, so as to avoid occurrence of pressing by mistake.

DETAILED DESCRIPTION OF THE PREFERRED EMBODIMENT

Figure 1:
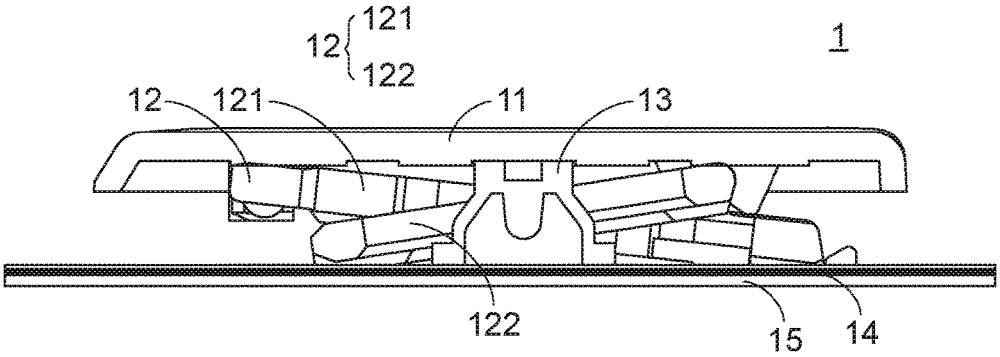
FIG.1 PRIOR ART
FIG. 1 is a schematic cross-sectional side view of a conventional key structure.
Figure 2:
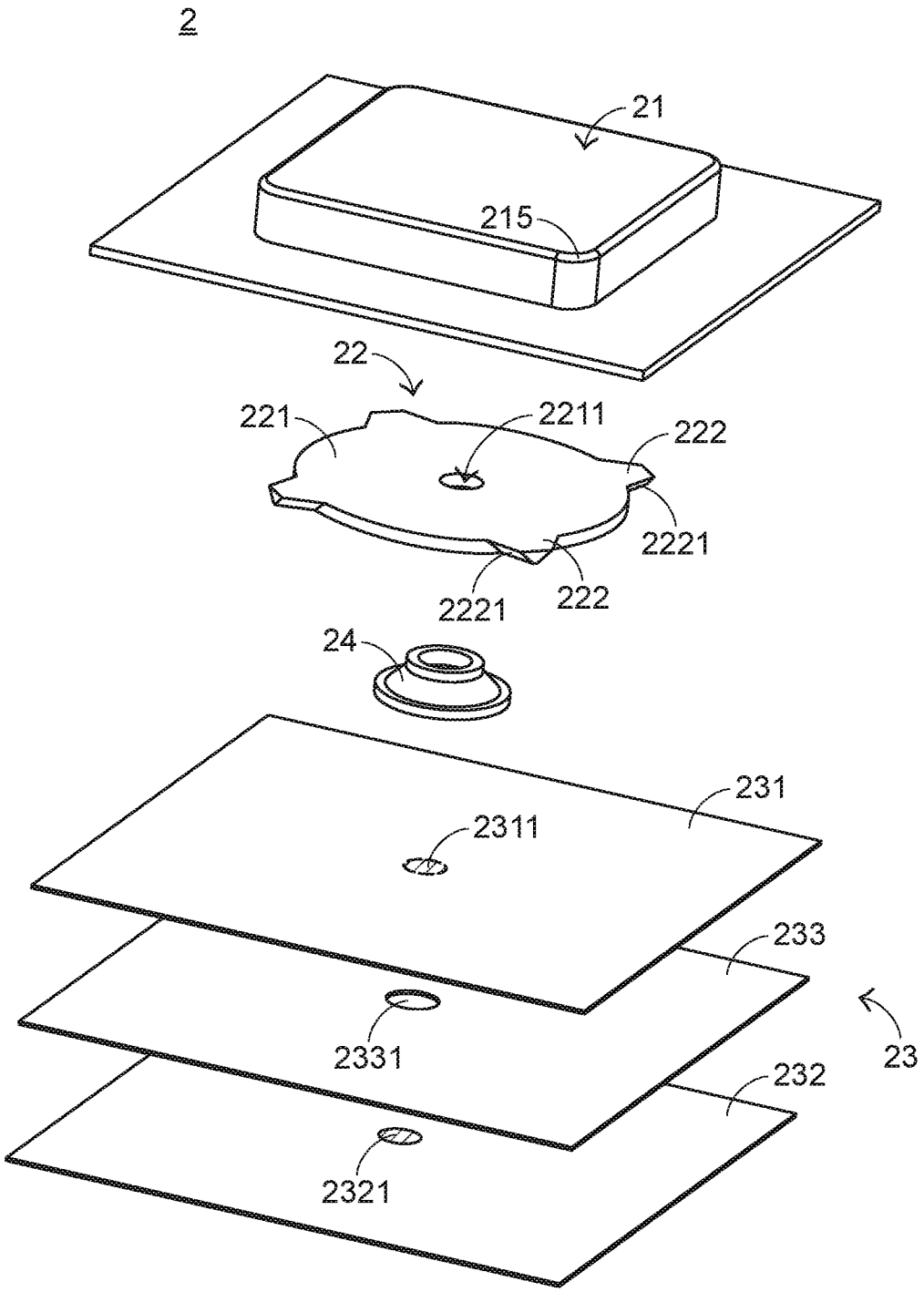
FIG. 2 is a schematic structural exploded diagram of a key structure according to a preferable embodiment of the present invention.
Figure 3:
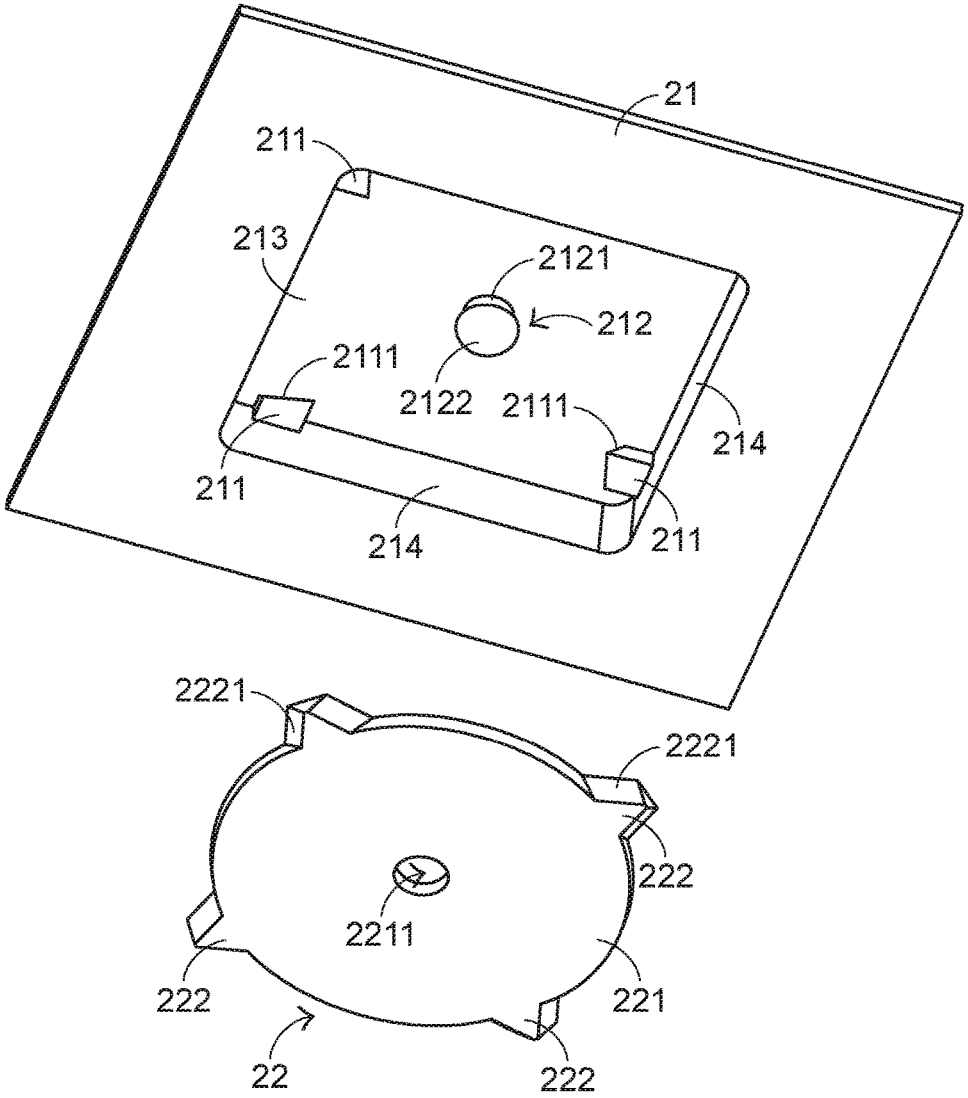
FIG. 3 is a schematic structural diagram of a flexible key cap and a conducting plate of a key structure of the present invention according to a preferable embodiment of the present invention.

In view of the problem of the existing technology, the present invention provides a key structure having a thin and light appearance and capable of avoiding maloperation, so as to resolve the problem of the existing technology. Referring to FIG. 2 and FIG. 3, FIG. 2 is a schematic structural exploded diagram of a key structure according to a preferable embodiment of the present invention, and FIG. 3 is a schematic structural diagram of a flexible key cap and a conducting plate of a key structure of the present invention according to a preferable embodiment of the present invention. The key structure 2 includes a flexible key cap 21, a conducting plate 22, a switch circuit board 23, and an elastic element 24. The flexible key cap 21 is exposed out of the key structure 2 and is capable of being pressed to deform, and the flexible key cap 21 includes a plurality of oblique pyramids 211 and a fixing column 212. The conducting plate 22 is fixed on an inner surface 213 of the flexible key cap 21 and contacts a plurality of inner sidewalls 214 of the flexible key cap 21. The switch circuit board 23 is disposed below the conducting plate 22 and configured to be triggered due to deformation of the flexible key cap 21, so as to generate a key signal. The elastic element 24 is disposed between the conducting plate 22 and the switch circuit board 23 and is capable of being pushed by the conducting plate 22 to press the switch circuit board 23. In this preferable embodiment, the elastic element 24 is an elastic rubber body and is made of an elastic rubber material.

When the flexible key cap 21 is pressed and receives a pressing force, the flexible key cap 21 deforms and is partially depressed, and the inner surface 213 of the flexible key cap 21 that deforms pushes the conducting plate 22, so that the conducting plate 22 twists and pushes the plurality of inner sidewalls 214 of the flexible key cap 21, so as to conduct the pressing force to a corner of the flexible key cap 21. Therefore, by means of the key structure 2 of the present invention, the problem of uneven stress of the flexible key cap 21 can be resolved.

The switch circuit board 23 includes an upper circuit board 231, a lower circuit board 232, and a separation layer 233. The upper circuit board 231 is in contact with the elastic element 24 and has an upper connecting point 2311. The lower circuit board 232 is located below the upper circuit board 231 and has a lower connecting point 2321 corresponding to the upper connecting point 2311. The separation layer 233 is located between the upper circuit board 231 and the lower circuit board 232, and the function of the separation layer 233 is separating the upper circuit board 231 and the lower circuit board 232, so as to avoid occurrence of maloperation of the upper connecting point 2311 and the corresponding lower connecting point 2321. In addition, the separation layer 233 has a separation layer opening 2331 corresponding to the upper connecting point 2311. When the elastic element 24 presses the upper circuit board 231, the upper connecting point 2311 extends into the separation layer opening 2331 to contact the lower connecting point 2321, so that the switch circuit board 23 generates a key signal. In this preferable embodiment, the switch circuit board 23 is a membrane switch circuit.

Figure 4:
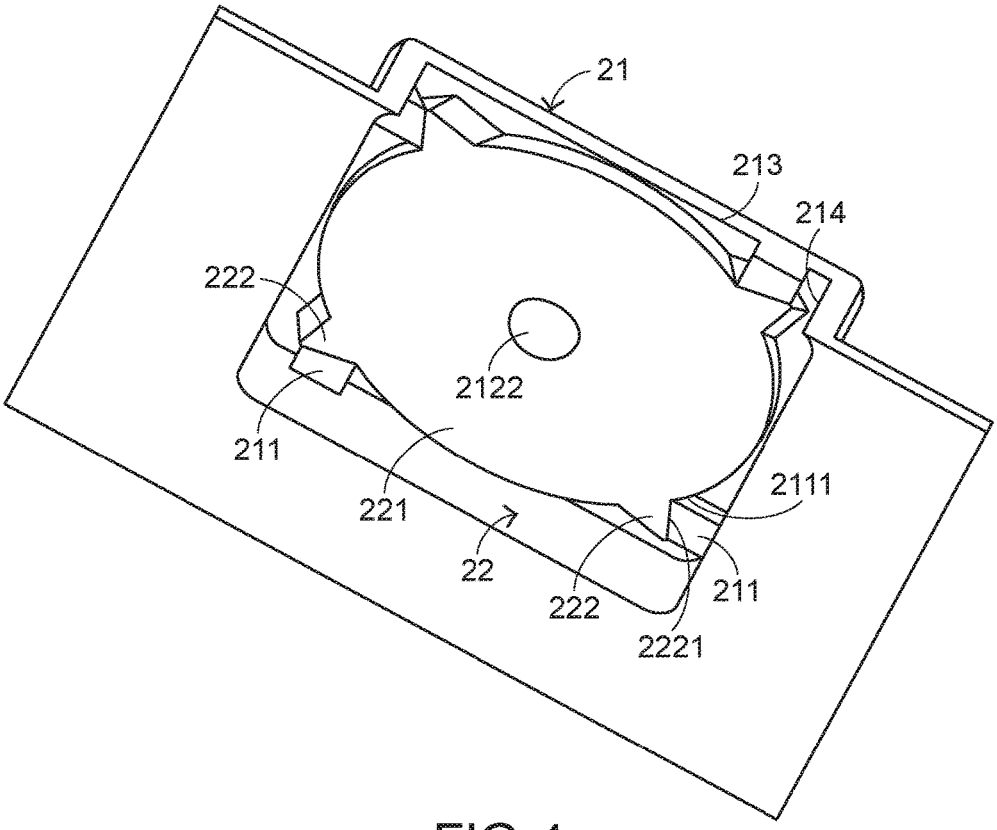
FIG. 4 is a schematic cross-sectional structural diagram of a part of a flexible key cap and a conducting plate of a key structure of the present invention according to a preferable embodiment of the present invention.

Referring to FIG. 2, FIG. 3, and FIG. 4, FIG. 4 is a schematic cross-sectional structural diagram of a part of a flexible key cap and a conducting plate of a key structure of the present invention according to a preferable embodiment of the present invention. In the flexible key cap 21, each of the oblique pyramids 211 corresponds to one inner sidewall 214 of the key cap 21 and extends out of the corresponding inner sidewall 214 of the key cap 21, and the oblique pyramid 211 is disposed on the corresponding inner sidewall 214 of the key cap 21 and is approximate to a corner 215 of the flexible key cap 21. The fixing column 212 is disposed on the inner surface 213 of the key cap 21 and extends out of the inner surface 213 of the key cap 21. Each oblique pyramid 211 has an asymmetrical slope 2112. The asymmetrical slope 2112 faces the inner surface 213 of the key cap 21, namely, facing upwards. The asymmetrical slope 2112 may contact the conducting plate 22 and may be pushed by the conducting plate 22, so as to conduct the received pressing force to the corner 215 of the flexible key cap 21. In this preferable embodiment, the plurality of oblique pyramids 211 and the fixing column 212 are integrally formed with the flexible key cap 21, and the flexible key cap 21 is made of an elastic rubber material.

In FIG. 2, FIG. 3, and FIG. 4, the conducting plate 22 includes a body 221 and a plurality of extended protrusions 222. The body 221 has an opening 2211, and the fixing column 212 of the flexible key cap 21 is enabled to pass through the opening 2211, to fix the body 221 onto the inner surface 213 of the flexible key cap 21. The plurality of extended protrusions 222 extends out of the body 221, and each extended protrusion 222 corresponds to one oblique pyramid 211. In addition, each extended protrusion 222 has a contact slope 2221. The contact slope 2221 corresponds to one asymmetrical slope 2112 and is capable of being in contact with the corresponding asymmetrical slope 2112, as shown in FIG. 4. In this preferable embodiment, the extended protrusion 222 is integrally formed with the body 221, and the body 221 is made of an elastic rubber material.

In another aspect, the fixing column 212 of the flexible key cap 21 includes a column 2121 and a limiting portion 2122, and the column 2121 may pass through the opening 2211 of the body 221. The limiting portion 2122 is disposed at one end of the column 2121 and is capable of being in contact with the body 221 when the body 221 is sheathed around the column 2121, so as to fix the body 221 onto the inner surface 213 of the flexible key cap 21. It should be specially noted that although the size of the limiting portion 2122 is larger than that of the opening 2211, the limiting portion 2122 can deform slightly to expand the opening 2211 because the body 221 is made of an elastic rubber material, so as to sheath the body 221 around the column 2121.

Figure 5:
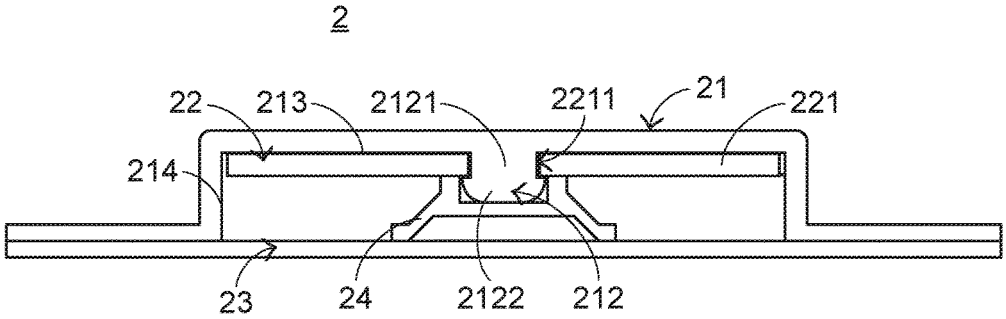
FIG. 5 is a schematic cross-sectional structural side view of a key structure according to a preferable embodiment of the present invention.

Referring to FIG. 2, FIG. 3, FIG. 4, and FIG. 5, FIG. 5 is a schematic cross-sectional structural side view of a key structure according to a preferable embodiment of the present invention. FIG. 5 shows the key structure 2 formed by combining all the elements. In addition, the operation of the key structure 2 of the present invention when being pressed by a user is as follows: when a finger of the user presses any corner 215 of the flexible key cap 21, the flexible key cap 21 deforms and the inner surface 213 of the flexible key cap 21 is enabled to push the body 221 of the conducting plate 22; the pushed body 221 twists due to the structure of the plurality of contact slopes 2221 and the corresponding asymmetrical slopes 2112, so that the plurality of contact slopes 2221 push the asymmetrical slopes 2112, to conduct the pressing force to the other corners 215 of the flexible key cap 21. It should be specially noted that, the torsion direction of the conducting plate 22 is determined by the configuration direction of the asymmetrical slopes 2112 and the configuration direction of the corresponding contact slope 2221.

In another aspect, the twisted body 221 downwards pushes the elastic element 24, so that the deformed elastic element 24 presses the switch circuit board 23, so as to trigger the switch circuit board 23 to generate a key signal. When the user stops pressing the flexible key cap 21, the elastic element 24 recovers to the original state from the deformed state and meanwhile provides an upward pushing force to the body 221, so that the conducting plate 22 is pushed back to the position before being pressed. In addition, the flexible key cap 21 also recovers to the original state from the deformed state.

As can be learned from the above that in the key structure of the present invention, the problem of uneven stress of the flexible key cap is alleviated by utilizing the structure of the flexible key cap and the conducting plate. Each inner sidewall of the flexible key cap is provided with an oblique pyramid, and the oblique pyramid is approximate to a corner of the flexible key cap. In addition, the conducting plate has extended protrusions that extend out of the body, so as to respectively contact the oblique pyramids. The oblique pyramid has an asymmetrical slope facing upwards, and the extended protrusion has a contact slope facing downwards. When the flexible key cap receives a pressing force to deform, the pressing force may be conducted to a corner of the flexible key cap by means of the body, the extended protrusion, and the oblique pyramid. In this way, the problem of uneven stress of the flexible key cap can be resolved, so as to avoid occurrence of pressing by mistake.

The above are only the preferable embodiments of the present invention, and the present invention needs not be limited to the disclosed embodiments. Therefore, all equivalent changes or modifications included within the spirit and scope of the present invention fall within the scope of the claims of the present invention.

What is claimed is:

1. A key structure, comprising:

a flexible key cap, exposed out of the key structure, and configured to be pressed to deform;

a conducting plate, fixed on an inner surface of the flexible key cap and in contact with a plurality of inner sidewalls of the flexible key cap;

a switch circuit board, disposed below the conducting plate, and configured to be triggered due to deformation of the flexible key cap, so as to generate a key signal; and an elastic element, disposed between the conducting plate and the switch circuit board, and configured to be pushed by the conducting plate to press the switch circuit board, wherein when the flexible key cap is pressed and receives a pressing force, the conducting plate twists due to the flexible key cap that deforms and pushes the plurality of inner sidewalls of the flexible key cap, so as to conduct the pressing force to a corner of the flexible key cap, wherein the flexible key cap comprises:

a plurality of oblique pyramids, wherein each of the oblique pyramids corresponds to the inner sidewall of the key cap and extends out of the corresponding inner sidewall of the key cap, and the oblique pyramid is disposed on the corresponding inner sidewall of the key cap and is approximate to the corner of the flexible key cap; and a fixing column, disposed on an inner surface of the key cap and extending out of the inner surface of the key cap.

2. The key structure according to claim 1, wherein the oblique pyramid has an asymmetrical slope, facing the inner surface of the key cap and configured to contact the conducting plate, and the twisted conducting plate is pushed, to conduct the pressing force to the corner of the flexible key cap.

3. The key structure according to claim 2, wherein a torsion direction of the conducting plate is determined by a configuration direction of the asymmetrical slope.

4. The key structure according to claim 2, wherein the conducting plate comprises:

a body, having an opening, wherein the fixing column is enabled to pass through the opening, to fix the body onto the inner surface of the flexible key cap; and a plurality of extended protrusions, extending out of the body, wherein each of the extended protrusions corresponds to one of the oblique pyramids, and each of the extended protrusions has a contact slope, corresponding to the asymmetrical slope and configured to contact the corresponding asymmetrical slope.

5. The key structure according to claim 4, wherein the plurality of extended protrusions is integrally formed with the body, and the body is made of an elastic rubber material.

6. The key structure according to claim 4, wherein the fixing column comprises:

a column, passing through the opening; and a limiting portion, disposed at one end of the column and configured to contact the body when the body is sheathed around the column, to fix the body onto the inner surface of the flexible key cap.

7. The key structure according to claim 4, wherein when the flexible key cap receives the pressing force, the flexible key cap deforms and pushes the body, and the pushed body twists, so that the plurality of contact slopes pushes the asymmetrical slope, to conduct the pressing force to the corner of the flexible key cap.

8. The key structure according to claim 1, wherein the plurality of oblique pyramids and the fixing column are integrally formed with the flexible key cap, and the flexible key cap is made of an elastic rubber material.

9. The key structure according to claim 1, wherein the switch circuit board comprises:

an upper circuit board, in contact with the elastic element, and the upper circuit board having an upper connecting point;

a lower circuit board, located below the upper circuit board, and the lower circuit board having a lower connecting point; and a separation layer, disposed between the upper circuit board and the lower circuit board, and configured to separate the upper circuit board and the lower circuit board, wherein the separation layer has a separation layer opening; when the elastic element presses the upper circuit board, the upper connecting point extends into the separation layer opening to contact the lower connecting point, so that the switch circuit board generates the key signal.

10. A key structure, comprising:

a flexible key cap, exposed out of the key structure, and configured to be pressed to deform;

a conducting plate, fixed on an inner surface of the flexible key cap and in contact with a plurality of inner sidewalls of the flexible key cap;

a switch circuit board, disposed below the conducting plate, and configured to be triggered due to deformation of the flexible key cap, so as to generate a key signal; and an elastic element, disposed between the conducting plate and the switch circuit board, and configured to be pushed by the conducting plate to press the switch circuit board, wherein when the flexible key cap is pressed and receives a pressing force, the conducting plate twists due to the flexible key cap that deforms and pushes the plurality of inner sidewalls of the flexible key cap, so as to conduct the pressing force to a corner of the flexible key cap, wherein the switch circuit board comprises:

an upper circuit board, in contact with the elastic element, and the upper circuit board having an upper connecting point;

a lower circuit board, located below the upper circuit board, and the lower circuit board having a lower connecting point; and a separation layer, disposed between the upper circuit board and the lower circuit board, and configured to separate the upper circuit board and the lower circuit board, wherein the separation layer has a separation layer opening; when the elastic element presses the upper circuit board, the upper connecting point extends into the separation layer opening to contact the lower connecting point, so that the switch circuit board generates the key signal.

* * * * *